US005412278A

United States Patent [19]

Iwasaki

[11] Patent Number: 5,412,278

[45] Date of Patent: May 2, 1995

[54] CATHODE-RAY TUBE WITH ANTI-REFLECTIVE COATING

[75] Inventor: Yasuo Iwasaki, Nagaokakyo, Japan

[73] Assignee: Mitsubishi Denki Kabushiki Kaisha, Tokyo, Japan

[21] Appl. No.: 961,325

[22] Filed: Oct. 15, 1992

[30] Foreign Application Priority Data

Oct. 22, 1991 [JP] Japan ..... 3-273669

[51] Int. Cl.[6] ..... H01J 29/88

[52] U.S. Cl. ..... 313/478; 313/479; 313/112; 427/126.3

[58] Field of Search ..... 313/461, 466, 473, 474, 313/478, 479, 112, 480; 427/106, 126.2, 126.3, 126.4

[56] References Cited

U.S. PATENT DOCUMENTS

| | | | |
|---|---|---|---|
| 2,670,279 | 2/1954 | Szegho et al. . | |
| 3,114,668 | 6/1961 | Guiles . | |
| 4,310,783 | 1/1982 | Temple et al. . | |
| 4,310,784 | 1/1982 | Anthon et al. . | |
| 4,633,131 | 12/1986 | Khurgin . | |
| 4,731,558 | 3/1988 | Haisma et al. . | |
| 4,945,282 | 7/1990 | Kawamura et al. | 313/479 |
| 5,107,173 | 4/1992 | Iwasaki | 313/478 X |
| 5,153,481 | 10/1992 | Matsuda et al. | 313/478 X |
| 5,179,318 | 1/1993 | Maeda et al. | 313/479 X |
| 5,243,255 | 9/1993 | Iwasaki | 313/479 X |

FOREIGN PATENT DOCUMENTS

| | | |
|---|---|---|
| 1359720 | 9/1971 | United Kingdom . |
| 2161320 | 6/1985 | United Kingdom . |

*Primary Examiner*—Donald J. Yusko
*Assistant Examiner*—N. D. Patel

[57] ABSTRACT

A cathode-ray tube has a faceplate on which is formed an anti-reflective coating with at least two layers. The first layer is formed on the outer surface of the faceplate by spin-coating an alcohol solution of an organometallic compound, leaving a porous metal oxide layer. The second layer is formed on the first layer by spin-coating an alcohol solution of silicon alkoxide, leaving a porous silica layer. Both layers are baked, and the first layer is baked or cured before the second layer is applied. The first layer has a higher index of refraction than the second layer.

40 Claims, 13 Drawing Sheets

CATHODE-RAY TUBE WITH ANTI-REFLECTIVE COATING

BACKGROUND OF THE INVENTION

This invention relates to a cathode-ray tube such as a color television picture tube. More particularly, it relates to a cathode-ray tube with an anti-reflective coating and a method of forming the anti-reflective coating.

It is known that the contrast performance of a cathode-ray tube is improved by reducing the optical transmittance of its faceplate. The demand for high image quality has led to the replacement of formerly-common clear faceplates having a transmittance of about eighty-five percent and gray faceplates having a transmittance of about sixty-nine percent by tinted faceplates having a transmittance of about fifty percent and dark-tinted faceplates having a transmittance of only about thirty-eight percent. To counter the attendant loss of brightness, and to improve focusing performance and permit larger screen dimensions, recent cathode-ray tubes also employ high accelerating voltages. Two resulting problems are specular reflection and charge-up.

Specular reflection refers to mirror-like reflection of ambient light from the outer surface of the faceplate. In clear and gray faceplates such specular reflection is generally masked by diffuse reflection from the inner surface of the faceplate, but in tinted and dark-tinted faceplates diffuse reflection is reduced and specular reflection becomes more noticeable. As a form of glare, specular reflection is a source of eye fatigue, and it is annoying for the viewer to see reflections of external objects (such as the viewer's own face) superimposed on the intended image.

Charge-up refers to the charging of the faceplate to a strong positive or negative potential when the cathode-ray tube is switched on or off, as a consequence of the high accelerating voltage. Undesirable results include crackling sounds, electrical discharges between the faceplate and the human body, and attraction of particles of dust and dirt to the faceplate.

The faceplates of some recent cathode-ray tubes have a silica coating with an inclusion of conductive filler particles and a dye or pigment. The conductive filler greatly reduces charge-up. The dye or pigment selectively absorbs light, thereby further reducing the optical transmittance of the faceplate and improving its contrast performance. The reduced transmittance, however, aggravates the problem of specular reflection. Specular reflection becomes particularly objectionable when the above type of coating is applied to a faceplate having a transmittance of fifty percent or less.

Past attempts to reduce specular reflection include roughening the surface of the faceplate, and providing an anti-reflective interference coating comprising, for example, layers of titanium oxide and magnesium fluoride. Roughening the faceplate, however, involves a loss of structural strength and image definition. Interference coatings are attractive, but they have conventionally been formed by vacuum processes such as evaporation deposition, the high cost of which has limited interference coatings to special-purpose cathode-ray tubes and ruled out their use in consumer items such as color television sets.

SUMMARY OF THE INVENTION

It is accordingly an object of the present invention to provide a cathode-ray tube with a low-cost anti-reflective coating.

Another object of the invention is to reduce specular reflection.

Yet another object of the invention is to prevent charge-up.

Still another object of the invention is to improve contrast performance.

These and other objects of the present invention are fulfilled by providing a cathode-ray tube having a faceplate with an anti-reflective coating comprising a first layer and a second layer. The first layer, disposed adjacent the faceplate, is formed by spin-coating an alcohol solution of an organometallic compound, and has a first index of refraction. The second layer, disposed adjacent the first layer, is formed by spin-coating an alcohol solution of silicon alkoxide, and has a second index of refraction lower than the first index of refraction.

These and other objects of the present application will become more readily apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DETAILED DESCRIPTION OF THE INVENTION

Embodiments of the invention will be described with reference to the attached drawings. These drawings illustrate the invention but do not restrict its scope, which should be determined solely from the appended claims.

Figure 1:
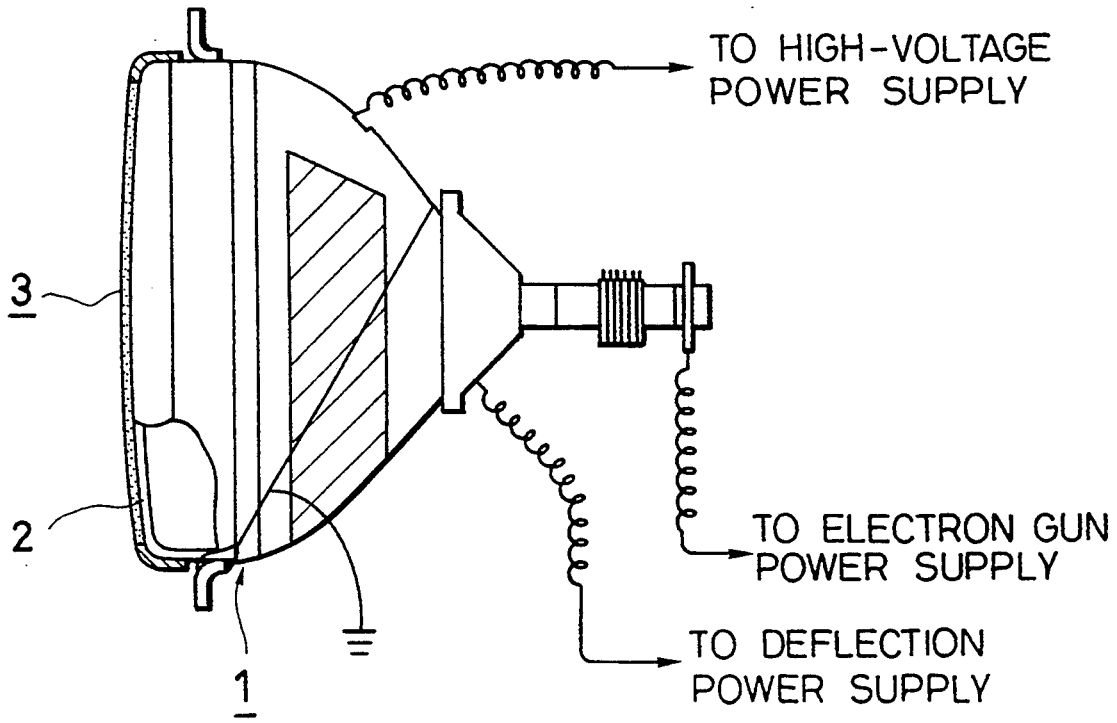
FIG. 1 is a partly cutaway general view of the invented cathode-ray tube.

Referring to FIG. 1, the invented cathode-ray tube 1 has a glass faceplate 2 with a novel anti-reflective coating 3 on its outer surface. The faceplate 2 is of the above-mentioned tinted or dark-tinted type, with an optical transmittance of fifty percent or less. FIG. 1 also indicates connections to an electron-gun power supply, a deflection power supply, and a high-voltage power supply for generating, deflecting, and accelerating electron beams. However, for the sake of brevity, the subsequent description will be confined to the anti-reflective coating 3.

Figure 2:
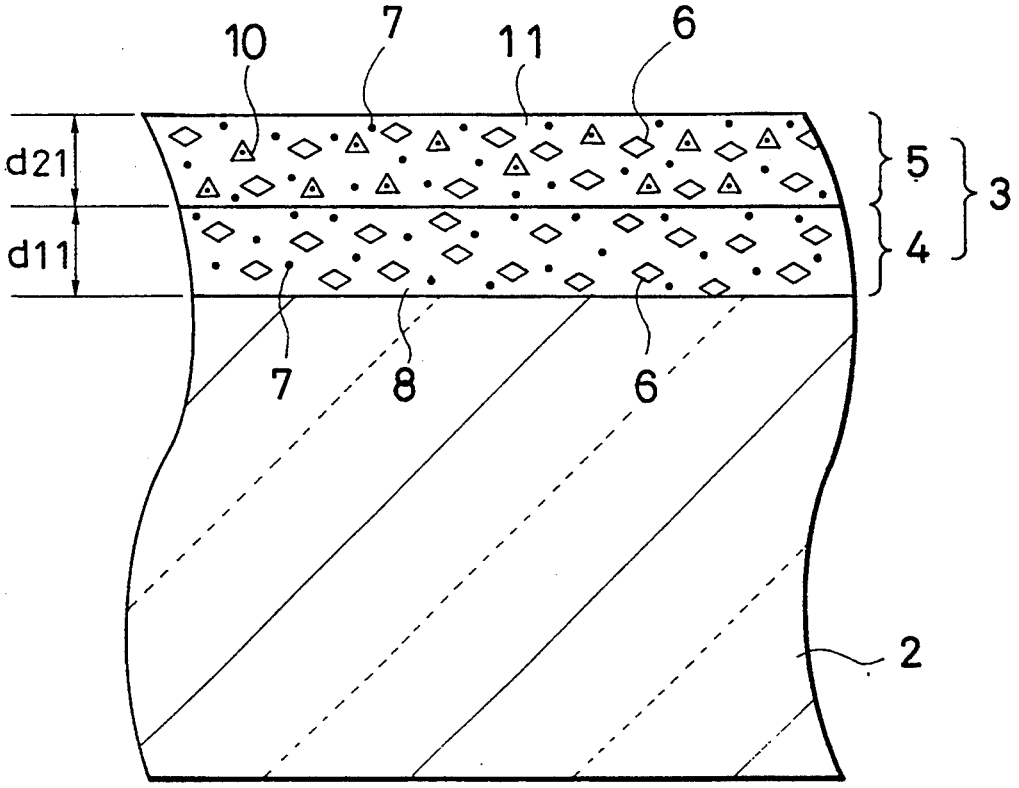
FIG. 2 is a sectional view illustrating a first novel anti-reflective coating.

Referring to FIG. 2, the anti-reflective coating 3 comprises two layers: a first layer 4 adjacent to the faceplate 2, having a thickness $d_{11}$, and a second layer 5 adjacent to the first layer 4, having a thickness $d_{21}$. Reflection is minimized by optimizing the thicknesses $d_{11}$ and $d_{21}$ and the indices of refraction of the two layers, using well-known formulas. Both $d_{11}$ and $d_{21}$ are roughly equal to one-fourth the wavelength of visible light.

The first layer 4 is formed by thoroughly cleaning the glass faceplate 2, then applying an alcohol-based solution comprising a titanium organometallic compound, an admixture of conductive filler particles 6, and a colorant 7. The conductive filler particles 6 comprise, for example, particles of tin oxide ($SnO_2$) or indium oxide ($In_2O_3$). The colorant 7 is an organic or inorganic dye or pigment that has an absorbing peak at a wavelength intermediate between red and green, as will be shown later. The solution is applied by the inexpensive, well-known spin-coating method, then cured by heating at 100° C. for thirty minutes, leaving a porous titanium oxide ($TiO_2$) layer 8 containing the above filler particles 6 and colorant 7. The purpose of curing the first layer 4 is harden it to a certain extent, thereby preventing elution when the second layer 5 is applied.

The invention is not limited to use of a titanium organometallic compound; other metallic elements such as tantalum or zirconium can be employed in place of titanium, for example. Further, the curing conditions are not limited to those stated above. It is possible to employ ultraviolet curing or chemical curing, for example.

After the first layer 4 has been cured, the second layer 5 is formed by applying an alcohol-based solution comprising silicon alkoxide, an admixture of conductive filler particles 6, a colorant 7, and a certain proportion of fine particles of magnesium fluoride ($MgF_2$) 10. The silicon alkoxide may have either an OH or OR functional group. The conductive filler particles 6 and colorant 7 are the same as in the first layer 4. The magnesium-fluoride particles 10 have an average diameter of three hundred angstroms. This solution is applied by the same inexpensive spin-coating method as was used to form the first layer 4. The result is a porous silica ($SiO_2$) layer 11 containing the above-described particles 6, 7, and 10.

The invention can obviously be practiced with magnesium fluoride particles 10 having an average diameter other than three hundred angstroms. To obtain a uniform layer with a low index of refraction, however, the average diameter of the magnesium fluoride particles 10 should not exceed one thousand angstroms, and should preferably be three hundred angstroms or less.

After the first and second layers 4 and 5 have been formed on the faceplate 2 as described above, the anti-reflective coating 3 is completed by baking for thirty minutes at a temperature of 175° C., to strengthen the anti-reflective coating 3 and stabilize its optical properties. With regard to the first layer 4, pure titanium oxide has an index of refraction of 2.35. However, this value is lowered by the presence of organic material, some of which remains even after baking, and the presence of the conductive filler particles 6 and colorant 7, so the index of refraction of the first layer 4 is approximately 2.0. With regard to the second layer 5, without the magnesium fluoride particles 10 this layer would have an index of refraction of 1.50 to 1.54, while magnesium fluoride itself has an index of refraction of 1.38. The proportion of magnesium fluoride particles 10 is such that the index of refraction of the second layer 5 is 1.42.

Because of these indices of refraction and the quarter-wave thicknesses of the first and second layers 4 and 5, a multilayer interference structure of the well-known (S)-H-L type is obtained, where S represents a glass substrate (the faceplate 2), H represents a film with a high index of refraction (the first layer 4), and L represents a film with a lower index of refraction (the second layer 5). Such structures are known to reduce reflection, and in the present case, average reflectivity is reduced from four percent to one percent, as will be shown later. In addition, the conductive filler particles 6 prevent charge-up and the colorant 7 improves contrast performance.

Figure 3:
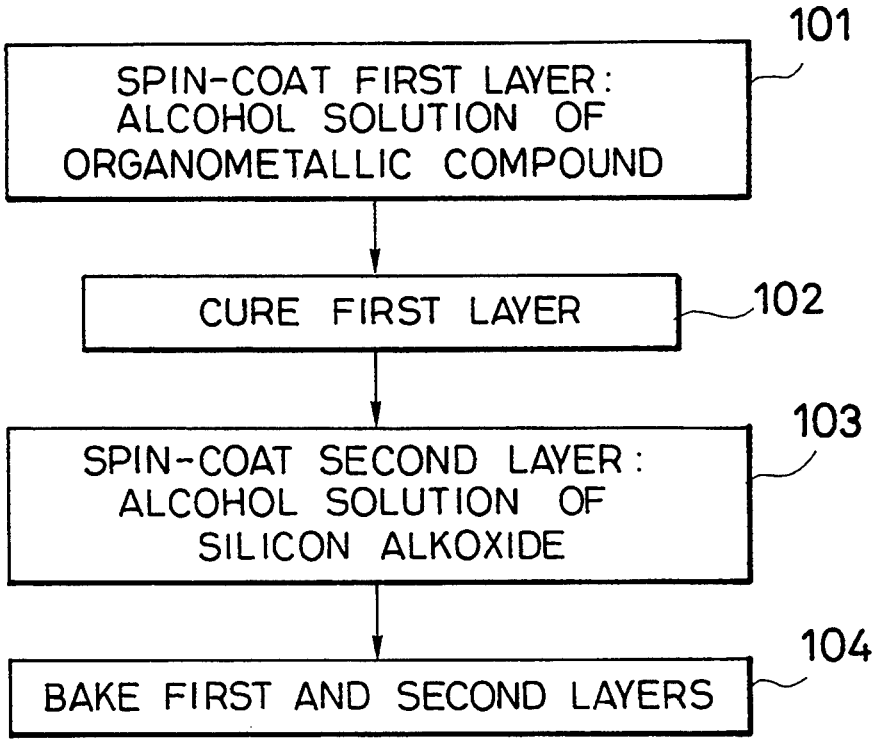
FIG. 3 is a flowchart summarizing a method of forming the novel anti-reflective coating.

The steps in formation of the anti-reflective coating 3 are summarized in FIG. 3. The first step 101 is to spin-coat an alcohol solution comprising an organometallic compound to form the first layer 4. The second step 102 is to cure the first layer 4. The third step 103 is to spin-coat an alcohol solution comprising silicon alkoxide to form the second layer 5. The fourth step 104 is to bake both the first and second layers 4 and 5.

From the standpoint of optimizing the physical properties of the first layer 4 and maximizing its strength, it would be advantageous to bake this layer at the highest possible temperature, preferably a temperature of at least 300° C. However, it is not possible to hold a completed cathode-ray tube at a temperature above 200° C. without impairing its mechanical strength and shortening its expected life, particularly with respect to emission characteristics. The process of manufacturing a cathode-ray tube, however, generally includes four steps performed at 300° C. or higher temperatures. The last these steps, for example, is the evacuation process, in which a high vacuum is created while the cathode-ray tube is raised to a temperature of substantially 380° C. to drive out gases. If the first layer 4 is spin-coated prior to this step, then the 380° C. evacuation process can both cure and bake the first layer 4 in a very satisfactory manner, giving this layer an extremely high degree of strength, and obviating the need for the 100° C. curing step described earlier. Afterward, the second layer 5 can be spin-coated and baked at 175° C. as already explained. Alternatively, the first and second layers 4 and 5 can both be spin-coated before the high-temperature steps in the conventional cathode-ray tube fabrication process are completed, and these high-temperature steps can be used to bake both layers.

Figure 4:
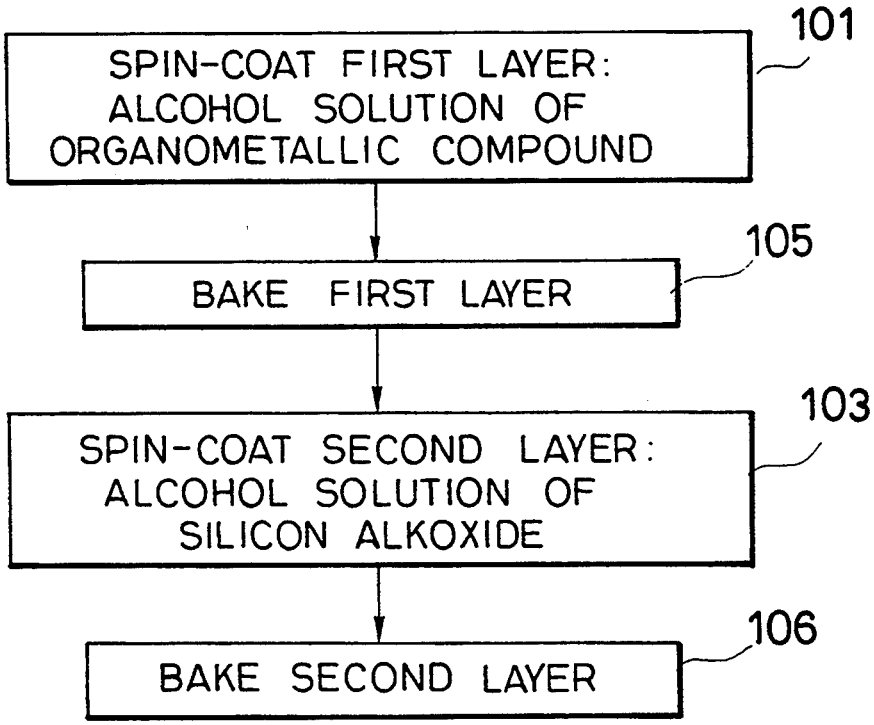
FIG. 4 is a flowchart summarizing another method of forming the novel anti-reflective coating.

FIG. 4 summarizes the above method of forming the anti-reflective coating 3. The first step 101 is the same as in FIG. 3. The second step 105 is to bake the first layer, preferably during a conventional high-temperature step in the manufacture of the cathode-ray tube, and preferably at a temperature of at least 300° C. The third step 103 is the same as the third step in FIG. 3. The fourth step 106 is to bake the second layer; this step may also be combined with a conventional high-temperature step in the manufacture of the cathode-ray tube.

Figure 5:
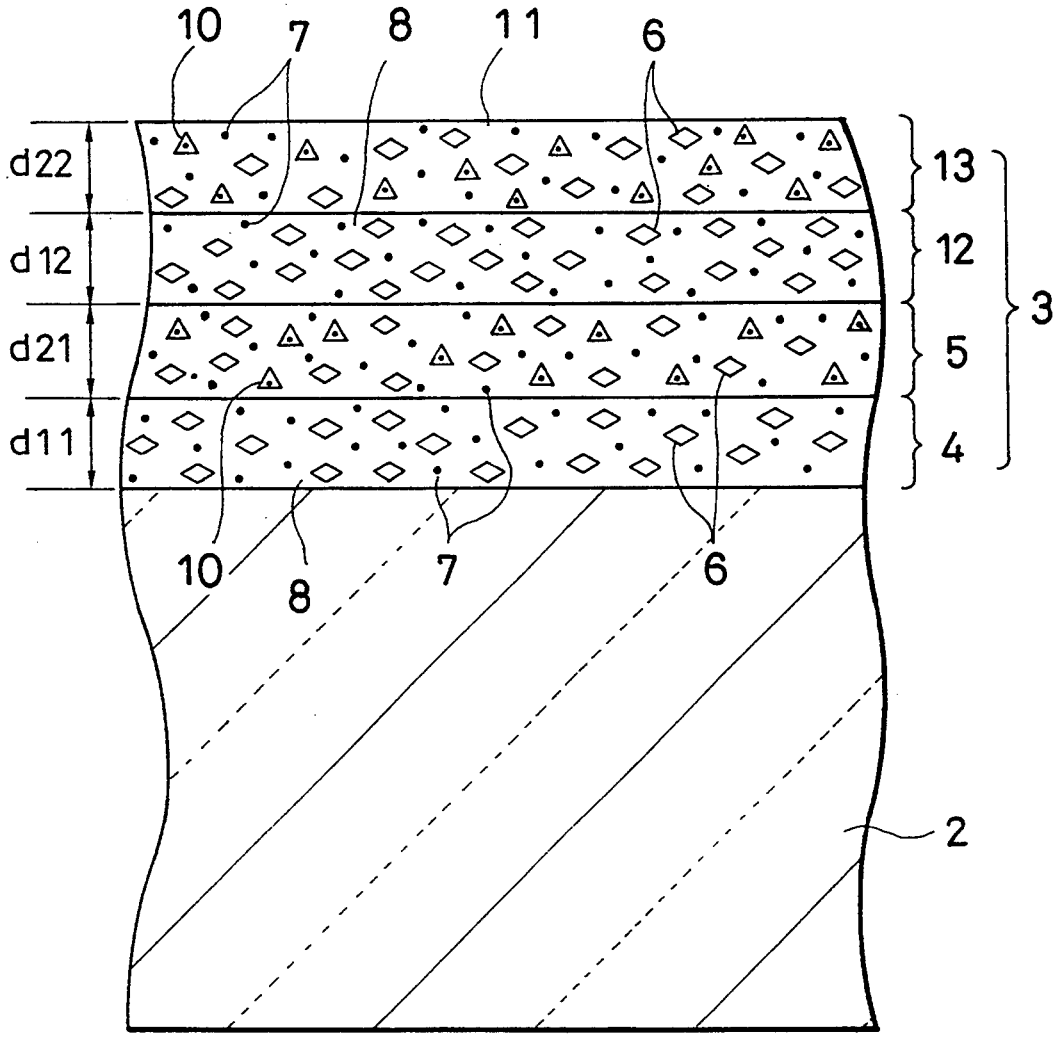
FIG. 5 is a sectional view illustrating a second novel anti-reflective coating.

Anti-reflective performance can be improved by using four layers instead of two. Referring to FIG. 5, another novel anti-reflective coating 3 comprises a first layer 4 identical in composition to the first layer 4 in FIG. 2; a second layer 5 identical in composition to the second layer 5 in FIG. 2; a third layer 12 identical in composition to the first layer 4; and a fourth layer 13 identical in composition to the second layer 5. Particles contained in these layers are denoted by the same symbols and reference numerals as in FIG. 2, and detailed descriptions will be omitted. The thicknesses $d_{11}$, $d_{21}$, $d_{12}$, and $d_{22}$ of the four layers are optimized to minimize reflectivity, again in accordance with well-known formulas. The four layers 4, 5, 12, and 13 are formed by spin-coating, curing, and baking processes as already described, each layer preferably being cured or baked before the next layer is applied.

Figure 6:
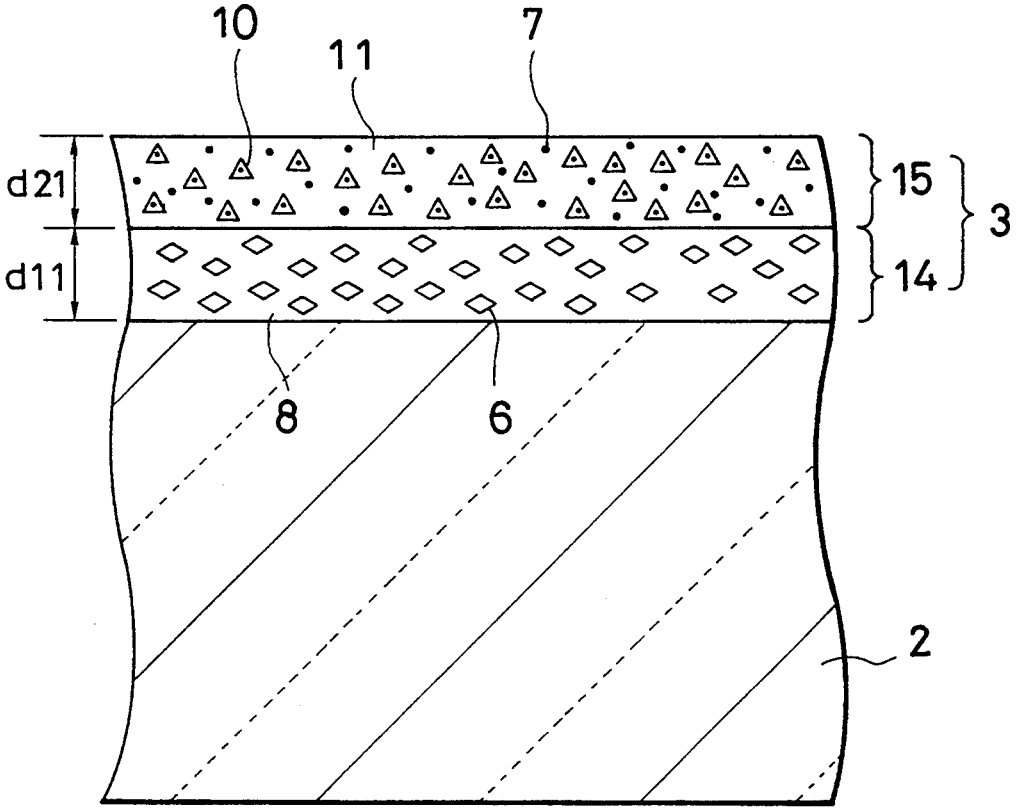
FIG. 6 is a sectional view illustrating a third novel anti-reflective coating.

Another way to improve the anti-reflective properties of the anti-reflective coating 3 is to provide conductive filler particles 6 only in the first layer, and colorant particles 7 only in the second layer. FIG. 6 shows a novel anti-reflective coating 3 of this type. The first layer 14 comprises the same porous titanium oxide 8 as in FIG. 2, but has a higher proportion of conductive filler particles 6. The second layer 15 comprises the same porous silica 11 as in FIG. 2 with the same colorant particles 7 and magnesium fluoride particles 10, but no conductive filler particles 6. Both layers are formed by spin-coating, curing, and baking as described above.

The conductive filler particles 6 have a high intrinsic index of refraction. Their higher proportion in the first layer 14 raises the index of refraction of that layer to substantially 2.05, as compared with 2.0 for the first layer 4 in FIG. 2. Similarly, the absence of conductive filler particles 6 in the second layer 15 lowers its index of refraction to 1.40, as compared with 1.42 for the second layer 5 in FIG. 2. The result is a noticeable improvement in the optical characteristics of the anti-reflective coating 3, as will be shown later.

The anti-reflective coating 3 in FIG. 6 can be further simplified by omitting the magnesium fluoride particles 10 from the second layer 15. A reasonably low index of refraction of substantially 1.45 is then obtained, still using an alcohol-based solution of silicon alkoxide.

Figure 7:
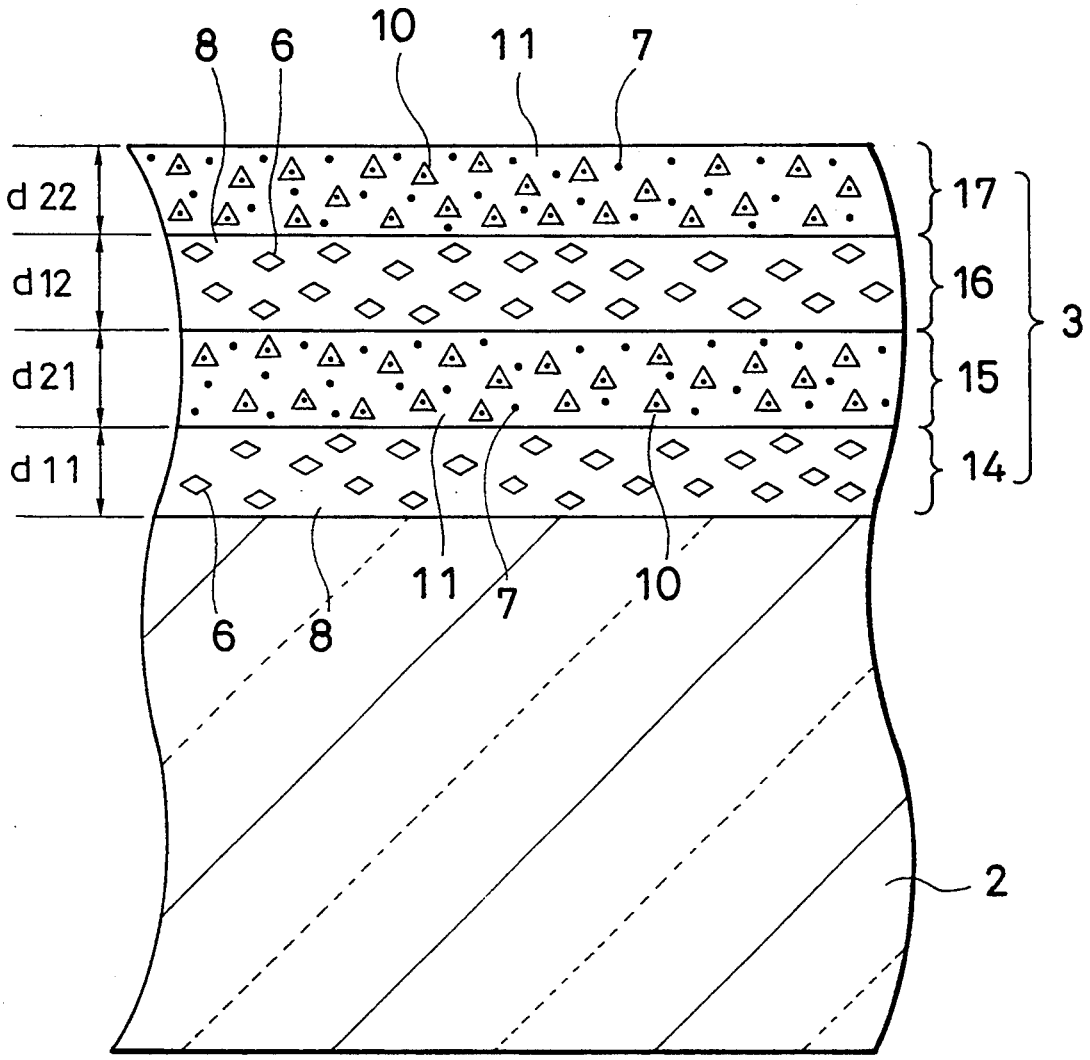
FIG. 7 is a sectional view illustrating a fourth novel anti-reflective coating.

Referring to FIG. 7, the above improvements can be combined by providing four layers: a first layer 14 identical in composition to the first layer 14 in FIG. 6; a second layer 15 identical in composition to the second layer 15 in FIG. 6; a third layer 16 identical in composition to the first layer 14; and a fourth layer 17 identical in composition to the second layer 15. All four layers are formed by spin-coating, curing, and baking as described above, and their thicknesses $d_{11}$, $d_{21}$, $d_{12}$, and $d_{22}$ are optimized to minimize reflection.

Figure 8:
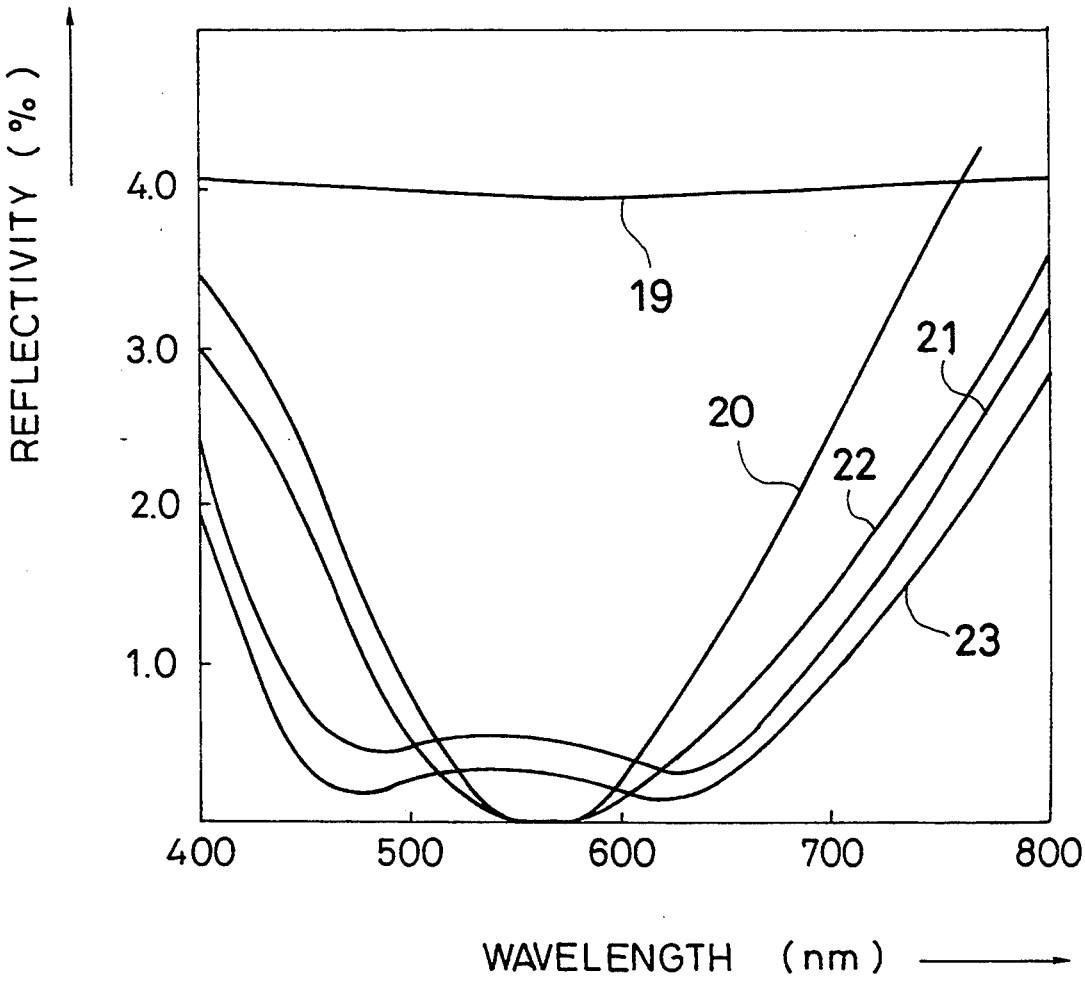
FIG. 8 is a graph illustrating the reflectivity characteristics of a conventional faceplate and of faceplates with the first, second, third, and fourth novel anti-reflective coatings.

FIG. 8 is a graph showing the anti-reflective performance of the novel coatings in FIGS. 2, 5, 6, and 7. Reflectivity is indicated on the vertical axis as a function of wavelength on the horizontal axis. The first curve 19 represents the reflectivity of an uncoated faceplate. The value 4% is typical of the reflectivity of a glass-air interface. The second curve 20 shows the reflectivity when the faceplate 2 is coated with an anti-reflective coating 3 of the type shown in FIG. 2. In the visible wavelength region the average reflectivity is now only 1.0%. The third curve 21 is for the four-layer anti-reflective coating 3 in FIG. 5; this coating reduces the average reflectivity in the visible wavelength region to only 0.4%. The fourth curve 22 is for the improved two-layer anti-reflective coating 3 in FIG. 6, which gives an average reflectivity in the visible wavelength region of 0.6%. The fifth curve 23 is for the improved four-layer anti-reflective coating 3 in FIG. 7, which gives an average reflectivity of 0.20%, only one-twentieth the reflectivity of the uncoated faceplate.

The effect of the novel anti-reflective coating 3 will now be described in more detail. For this purpose it will be necessary to discuss the structure and spectral properties of the faceplate.

Figure 9:
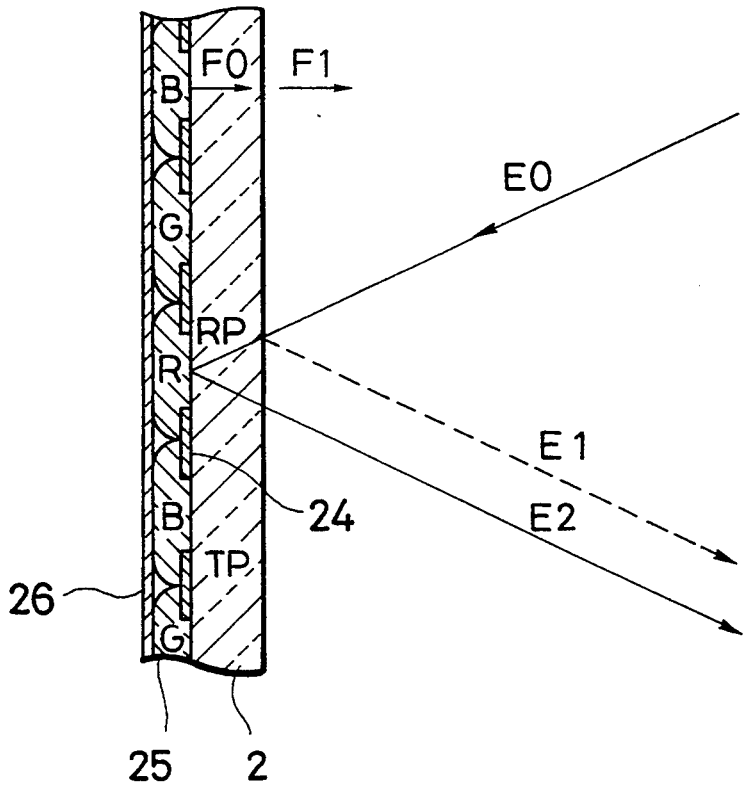
FIG. 9 PRIOR ART
FIG. 9 is a sectional view of a prior-art faceplate, illustrating two types of reflection.

Referring to FIG. 9, the inner surface of the faceplate 2 is coated with stripes 24 of a back, light-absorbing material such as graphite, and has a phosphor coating 25. The light-absorbing stripes 24 act as separators between red (R), green (G), and blue (B) phosphor stripes. Behind the phosphor coating 25 is a thin aluminum backing 26 that reflects light but is transparent to electron beams. For simplicity, FIG. 9 shows a prior-art faceplate with no coating on its outer surface.

Ambient light incident on the faceplate is reflected at both its inner and outer surfaces. Let $E_0$ be the intensity of the incident ambient light, $E_1$ be the intensity of the light reflected at the outer surface, and $E_2$ be the intensity of the light reflected at the inner surface, as indicated in FIG. 9. In addition, let $F_0$ be the intensity of light emitted by the phosphor coating 25, let $F_1$ be the intensity of this light after passage through the faceplate 2, let $T_B$ be the aperture ratio of the light-absorbing stripes 24, and let $T_P$ be the transmittance of the faceplate material 2. Furthermore, let $R_P$ be the total reflectivity of the stripes 24, the phosphor coating 25, and the aluminum backing 26. The contrast performance of the cathode-ray tube is indicated by a contrast index $C_T$ defined by the following equations:

$$C_T=(E_1+E_2+F_1)/(E_1+E_2)=1+F_1/(E_1+E_2)$$

$$F_1=F_O \cdot T_B \cdot T_P$$

$$E_1=0.04 \cdot E_O$$

$$E_2=(0.96)^2 E_O \cdot T_P^2[0.04+(0.96)^2 R_P]$$

The figure 0.04 is the reflectivity of the glass-air or glass-vacuum interface. Reducing the faceplate transmittance $T_P$ increases the contrast index $C_T$ because light from the phosphor coating 25 passes through the faceplate only one (the term $T_P$ in the equation for $F_1$), while ambient light reflected from the inner surface must pass through the faceplate twice (the term $T_P^2$ in the equation for $E_2$).

Figure 10:
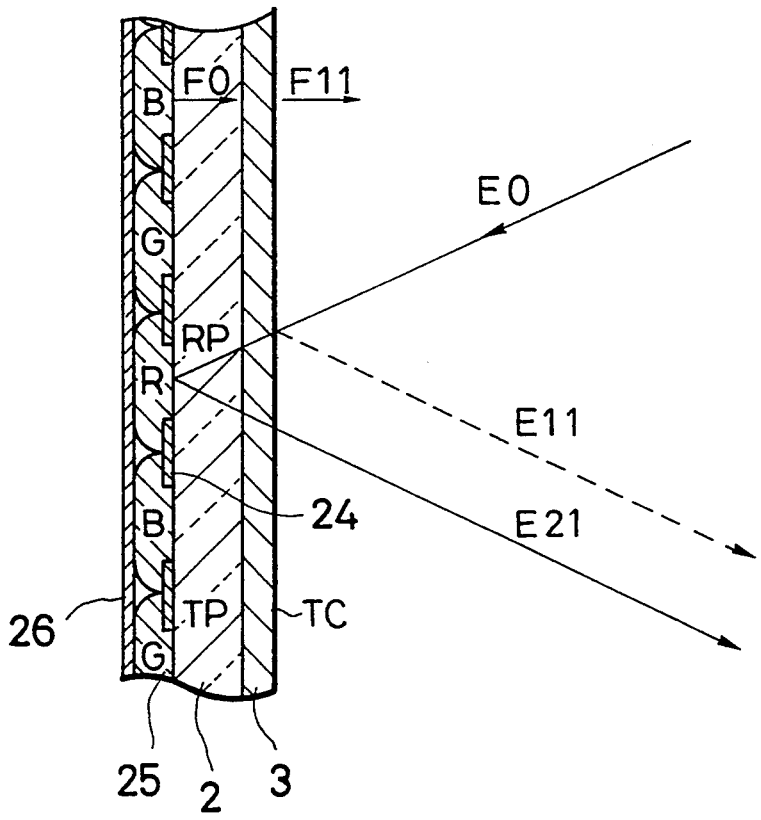
FIG. 10 is a sectional view of a faceplate according to the invention, illustrating two types of reflection.

Referring to FIG. 10, consider next a faceplate with an anti-reflective coating 3 that reduces reflection from four percent to one percent. The contrast index $C_T$ is the same as above except for this reflectivity difference and for the presence of an extra term $T_C$, representing the transmittance of the coating, in the definitions of $F_1$ and $E_2$:

$$F_1 = F_O \cdot T_B \cdot T_P \cdot T_C$$

$$E_1 = 0.01 \cdot E_O$$

$$E_2 = (0.99)^2 E_O \cdot T_P^2 \cdot T_C^2 [0.01 + (0.99)^2 R_P]$$

The anti-reflective coating 3 improves contrast performance in two ways. First, more of the reflection (99% instead of 96%) is shifted to the $E_2$ term. That is, more of the reflected light is reflected from the inner surface and is attenuated by a factor $T_P^2$ by passing twice through the faceplate 2. Second, this light is also attenuated by a factor $T_C^2$ by passing twice through the anti-reflective coating 3. Further details will be given later.

Figure 11:
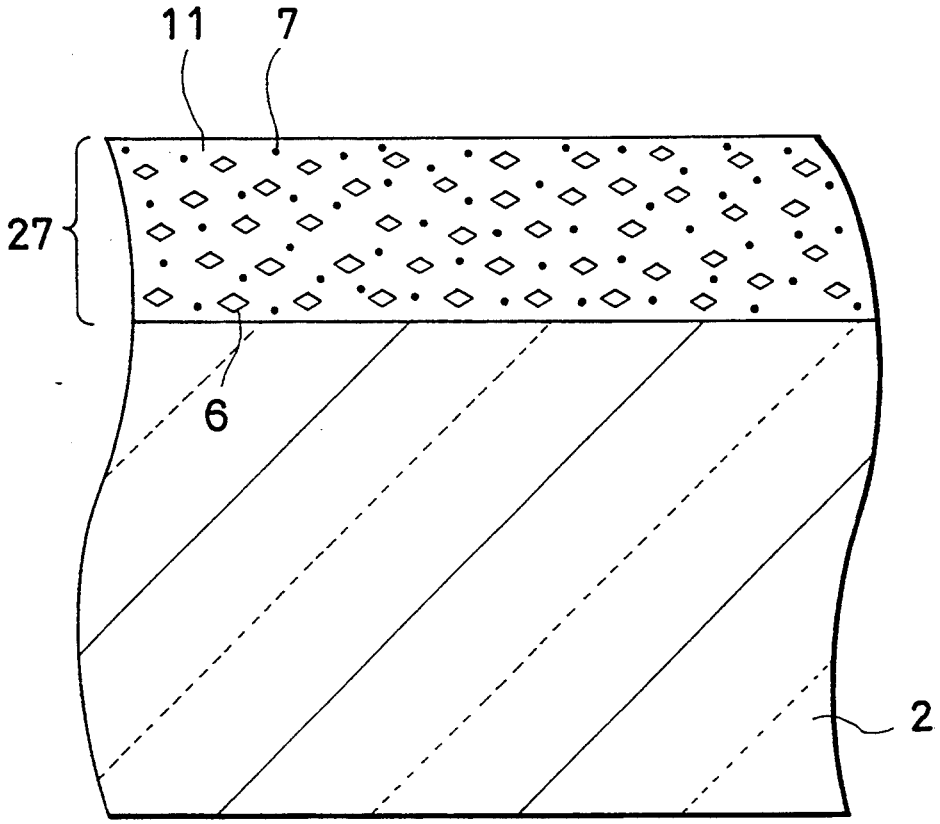
FIG. 11 PRIOR ART
FIG. 11 is a sectional view of a faceplate with a prior-art coating.

Faceplates having novel anti-reflective coatings 3 will now be compared with uncoated faceplates, and with faceplates having a prior-art coating. Referring to FIG. 11, the prior-art coating 27 comprises a silica layer 11 with conductive particles 6 and a dye or pigment colorant 7, but without magnesium fluoride. This coating is adapted to reduce charge-up and improve contrast performance, but its index of refraction is substantially the same as that of glass, so it has no anti-reflective function. The reflectivity of a faceplate with this prior-art coating 27 is substantially identical to that of an uncoated faceplate, shown by curve 19 in FIG. 8.

The parameters of interest in the comparison are the intensity of reflection from the outer surface ($E_1$) and inner surface ($E_2$) of the faceplate for a normalized intensity of incident ambient light ($E_0$), and in particular the ratio of reflection from the outer surface to total reflection, that is, $E_1/(E_1+E_2)$. This ratio represents the proportion of specular reflection from the outer surface in the total amount of reflection, which also comprises diffuse reflection from the inner surface. (Reflection from the inner surface tends to be diffuse because light is scattered by the phosphor material.) This ratio will be referred to below as the specular reflection ratio.

Table 1 shows these parameters for six prior-art faceplates (identified by the letters K to P) and twelve faceplates having novel anti-reflective coatings (M1 to P3). The specular reflection ratio is multiplied by one hundred and shown as a percent value. Faceplates K to N are uncoated; faceplates O and P have the prior-art coating shown in FIG. 11. Reflection ($E_1$) from the outer surface of all these faceplates is assumed to be four percent. Reflection ($E_2$) from the inner surface varies from 33.3 percent for a clear faceplate (K) to 4.7 percent for a dark-tinted faceplate with the prior-art coating (P). In this latter case (P), the specular reflection ratio is 48.2 percent, making specular reflection highly visible and annoying. Specular reflection is a significant problem in the other three prior-art tinted and dark-tinted faceplates (M, N, and O) as well.

Faceplates O1 and P1 have the novel anti-reflective coating (1) illustrated in FIG. 2. Faceplates M1 and N1 have this coating (2) without the colorant 7, for comparison with prior-art faceplates M and N. In all four cases the specular reflection ratio of the faceplate with the novel coating is only about one-third that of the corresponding prior-art faceplate.

Faceplates O2 and P2 have the novel four-layer anti-reflective coating (3) illustrated in FIG. 5, while faceplates M2 and N2 have this coating (4) without the colorant 7. In these faceplates the specular reflection ratio is reduced to only about one-seventh the value of the corresponding prior-art faceplate.

Faceplates O3 and P3 have the novel anti-reflective coating (5) illustrated in FIG. 6, while faceplates M3 and N3 have this coating (6) without the colorant 7. The specular reflection ratio is slightly higher than in faceplates M2 to P2, but is still less than two-thirds the corresponding values for faceplates M1 to P1. From these values it can be further deduced that faceplates with the four-layer coating illustrated in FIG. 7 should have specular reflection ratios less than one-tenth those of the corresponding prior-art faceplates.

TABLE 1

| Faceplate | | | $E_0$ | $E_1$ | $E_2$ | $E_1/(E_1+E_2) \times 100$ |
|---|---|---|---|---|---|---|
| K | Clear | ($T_p$ = 85%) | 100 | 4.0 | 33.3 | 10.7 |
| L | Gray | ($T_p$ = 69%) | 100 | 4.0 | 21.9 | 15.4 |
| M | Tinted | ($T_p$ = 50%) | 100 | 4.0 | 11.5 | 25.8 |
| N | Dark-tinted | ($T_p$ = 38%) | 100 | 4.0 | 6.7 | 37.4 |
| O | Tinted with prior-art coating | ($T_p$ = 50%) | 100 | 4.0 | 7.4 | 35.1 |
| P | Dark-tinted with prior-art coating | ($T_p$ = 38%) | 100 | 4.0 | 4.3 | 48.2 |
| M1 | Tinted with novel coating (1) | ($T_p$ = 50%) | 100 | 1.0 | 12.2 | 7.6 |
| N1 | Dark-tinted with novel coating (1) | ($T_p$ = 38%) | 100 | 1.0 | 7.0 | 12.5 |
| O1 | Tinted with novel coating (2) | ($T_p$ = 50%) | 100 | 1.0 | 7.8 | 11.4 |
| P1 | Dark-tinted with novel coating (2) | ($T_p$ = 38%) | 100 | 1.0 | 4.5 | 18.2 |
| M2 | Tinted with novel coating (3) | ($T_p$ = 50%) | 100 | 0.4 | 12.4 | 3.1 |
| N2 | Dark-tinted with novel coating (3) | ($T_p$ = 38%) | 100 | 0.4 | 7.1 | 5.3 |
| O2 | Tinted with novel coating (4) | ($T_p$ = 50%) | 100 | 0.4 | 7.9 | 4.8 |
| P2 | Dark-tinted with novel coating (4) | ($T_p$ = 38%) | 100 | 0.4 | 4.6 | 8.0 |
| M3 | Tinted with novel coating (5) | ($T_p$ = 50%) | 100 | 0.6 | 12.3 | 4.7 |
| N3 | Dark-tinted with novel coating (5) | ($T_p$ = 38%) | 100 | 0.6 | 7.1 | 7.8 |
| O3 | Tinted with novel coating (6) | ($T_p$ = 50%) | 100 | 0.6 | 7.9 | 7.1 |
| P3 | Dark-tinted | ($T_p$ = 38%) | 100 | 0.6 | 4.5 | 11.8 |

TABLE 1-continued

| Faceplate | $E_0$ | $E_1$ | $E_2$ | $E_1/(E_1 + E_2) \times 100$ |
|---|---|---|---|---|
| with novel coating (6) | | | | |

Figure 12:
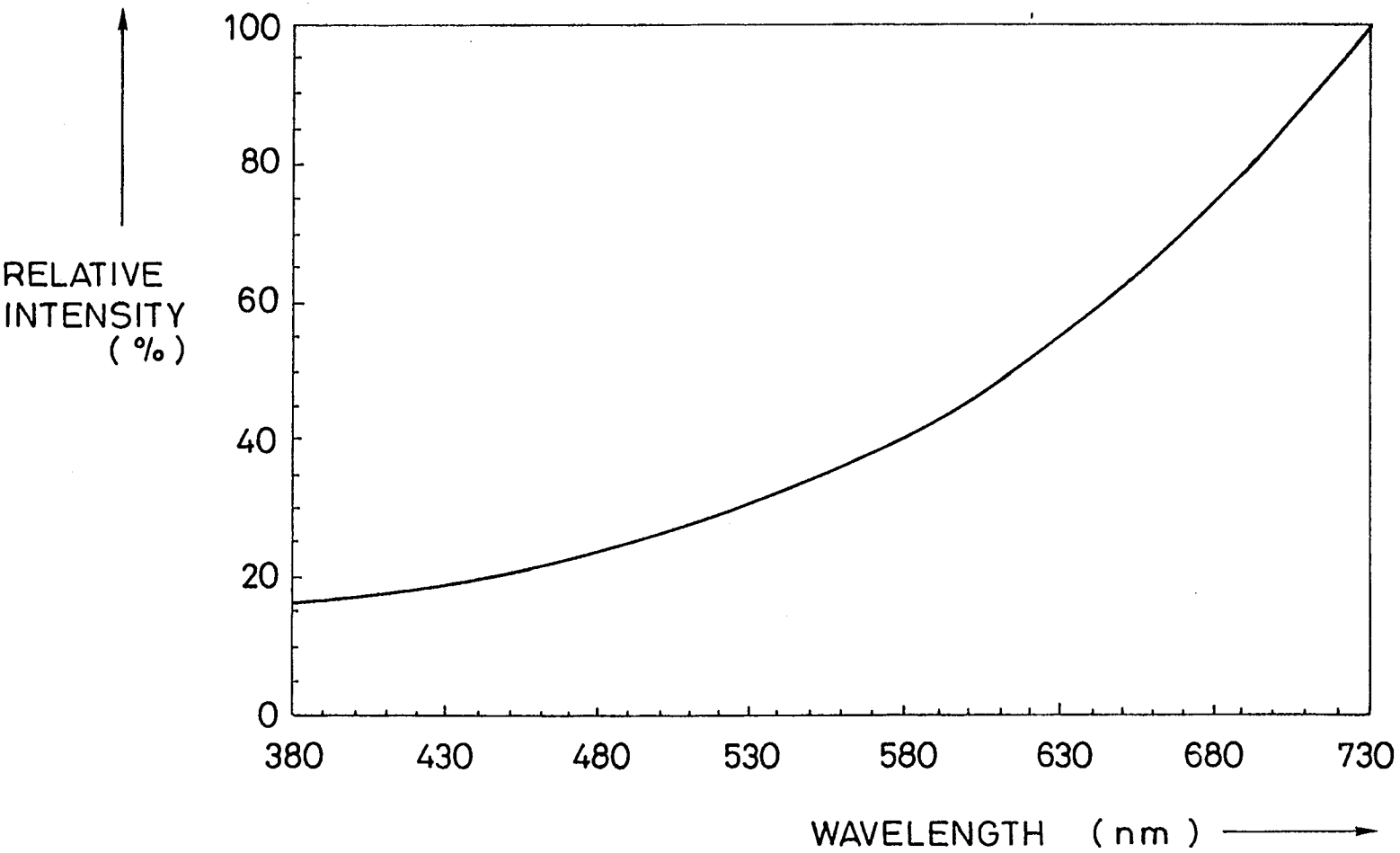
FIG. 12 is a graph illustrating the spectral characteristics of a light source used for testing purposes.

The reflection data in Table 1 were obtained by testing faceplates 13.0 mm thick, using a white incandescent light source. FIG. 12 shows the spectral characteristics of the light source in the wavelength range from 380 to 730 nm.

Figure 13:
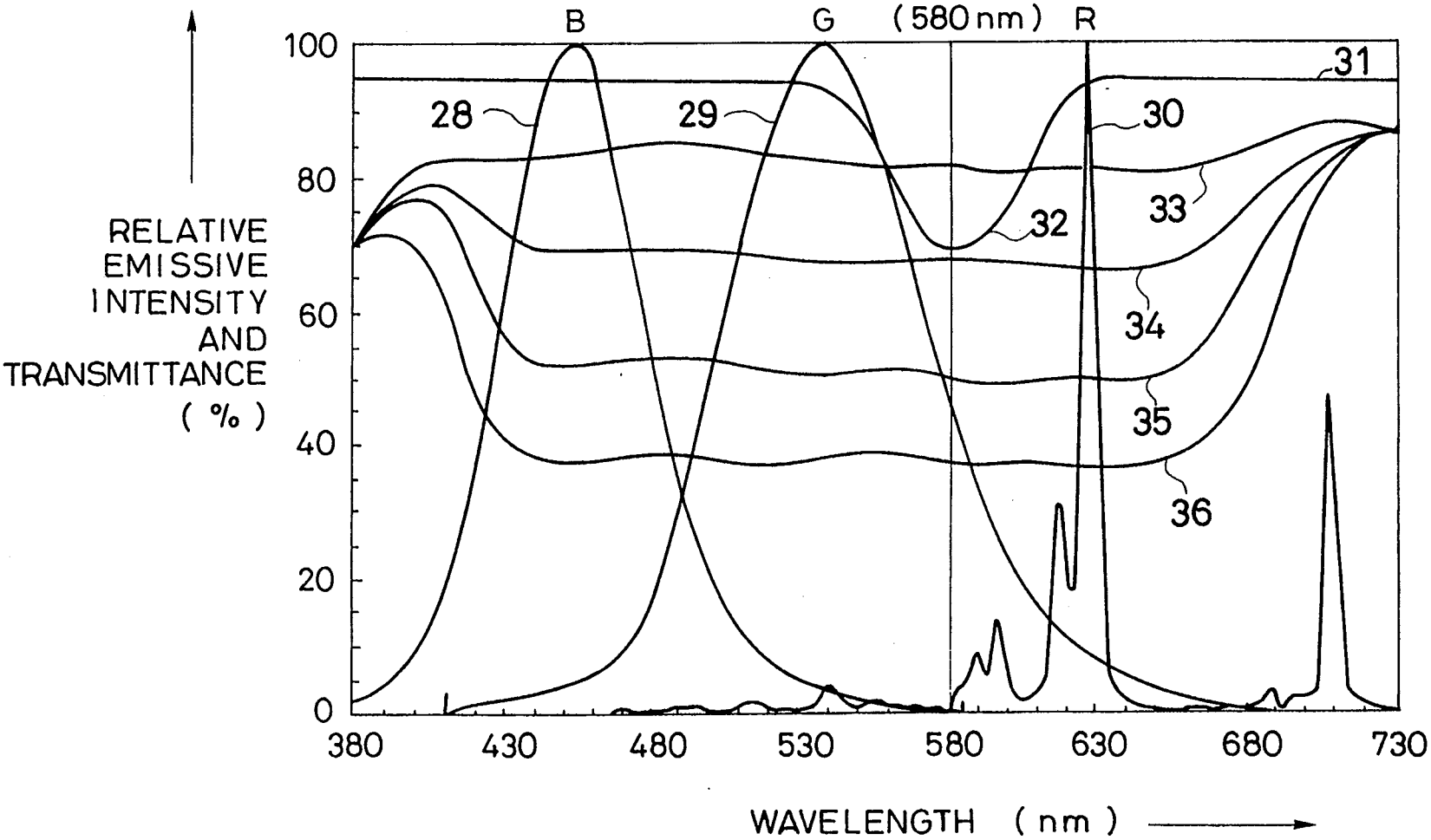
FIG. 13 is a graph illustrating phosphor emission characteristics and faceplate transmittance characteristics.

FIG. 13 shows the spectral characteristics of the above faceplates and their phosphors and coatings. Curve 28 represents the relative emissive intensity of the blue phosphor; curve 29 represents the relative emissive intensity of the green phosphor; and curve 30 represents the relative emissive intensity of the red phosphor. Curve 31 represents the absorption of the colorant 7 in the anti-reflective coating 3. This curve 31 has a peak 32 at 580 nm, substantially midway between the emission peaks of the green and red phosphors. The absorbing peak need not be located at precisely this wavelength, but should generally be in the range from 570 to 610 nm.

By absorbing light with wavelengths in the vicinity of the peak 32, the colorant reduces the reflection of ambient light without impairing the transmittance of green or red light generated by the phosphors. In this way it markedly improves the contrast performance of the faceplate. The absorption peak 32 is located between the green (G) and red (R) peaks, rather than between the blue (B) and green (G) peaks, because the human eye is much more sensitive to wavelengths between green and red. The colorant 7 also improves the color rendition characteristics of the cathode-ray tube by absorbing unwanted light emitted by the green and red phosphors: that is, it absorbs light emitted by the green phosphor on the long-wavelength side of the green peak (G), and light emitted by the red phosphor on the short-wavelength side of the red peak (R).

Curve 33 is the spectral transmittance curve of a clear faceplate. Curve 34 is the transmittance curve of a gray faceplate. Curve 35 is the transmittance curve of a tinted faceplate. Curve 36 is the transmittance curve of a dark-tinted faceplate. All four curves are substantially flat in the region including the red (R), green (G) and blue (B) emissive peaks.

Figure 14:
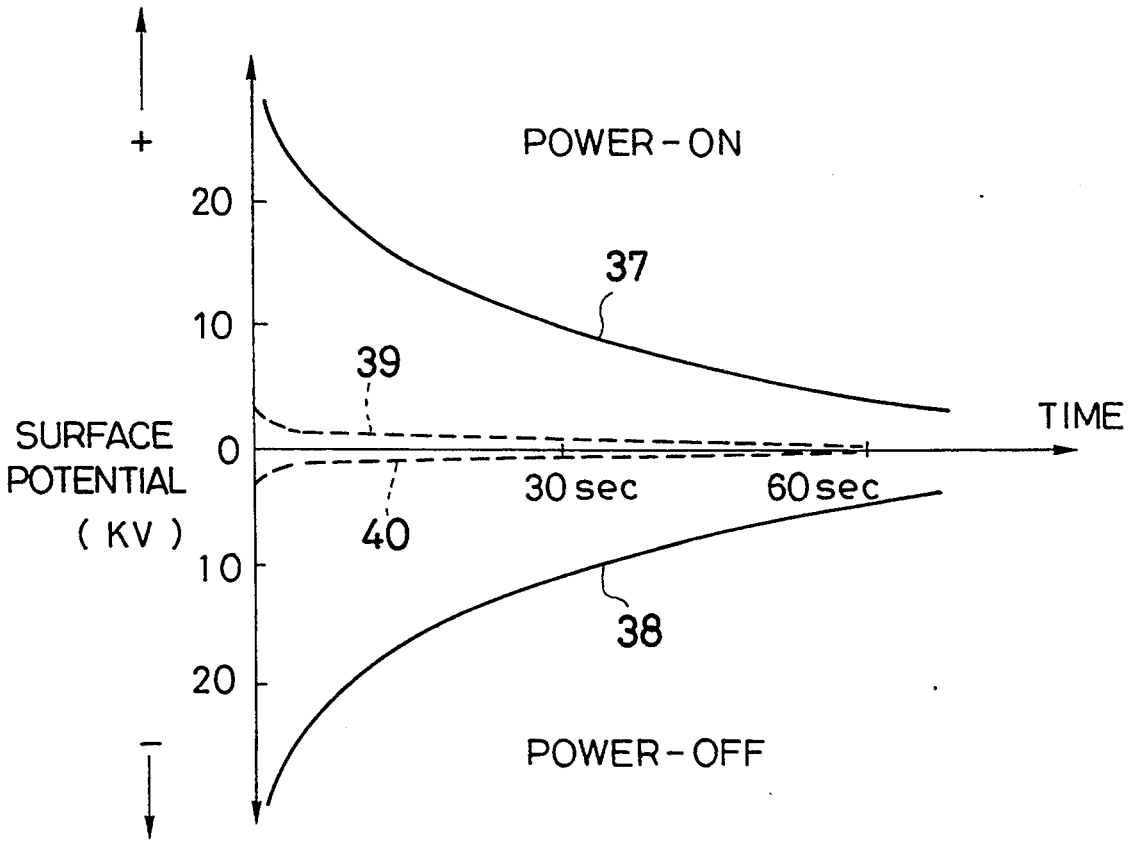
FIG. 14 is a graph illustrating faceplate potentials at power-on and power-off.

FIG. 14 illustrates the effect of the conductive filler particles 6 in the novel coatings, showing the surface potential of the faceplate 2 on the vertical axis and time on the horizontal axis. Without the conductive filler particles 6, when the cathode-ray tube is switched on it charges to an initial positive surface potential exceeding twenty kilovolts and takes more than a minute to discharge, as indicated by curve 37. When the cathode-ray tube is switched off, it charges to a negative surface potential exceeding minus twenty kilovolts and takes more than a minute to discharge, as indicated by curve 38. When conductive filler particles 6 are present in the coating, the corresponding charges are much less and discharge takes place within a minute, as indicated by curves 39 and 40.

Despite the advantages of including both conductive filler particles and a colorant with appropriate absorption properties in the anti-reflective coating, the invention can be practiced without the conductive filler particles, or without the colorant, or without both of these. Further modifications that will be apparent to those skilled in the art can also be made without departing from the spirit and scope of the invention as set forth in the following claims.

What is claimed is:

1. A cathode-ray tube comprising:

a tinted faceplate with an optical transmittance of at most fifty percent; and an anti-reflective coating formed on the tinted faceplate, the anti-reflective coating including, a first layer adjacent said tinted faceplate, formed of a spin-coated alcohol solution of an organometallic compound, and having a first index of refraction; and a second layer adjacent said first layer, formed of a spin-coated alcohol solution of silicon alkoxide, and having a second index of refraction lower than said first index of refraction.

2. The cathode-ray tube of claim 1, wherein said first layer and said second layer have respective thicknesses equal to one-fourth of a wavelength of visible light.

3. The cathode-ray tube of claim 1, wherein said silicon alkoxide has an OH functional group.

4. The cathode-ray tube of claim 1, wherein said silicon alkoxide has an OR functional group.

5. The cathode-ray tube of claim 1, wherein said organometallic compound comprises titanium as a metallic element.

6. The cathode-ray tube of claim 1, wherein said organometallic compound comprises tantalum as a metallic element.

7. The cathode-ray tube of claim 1, wherein said organometallic compound comprises zirconium as a metallic element.

8. The cathode-ray tube of claim 1, further comprising:

a third layer adjacent said second layer, formed of a spin-coated alcohol solution of an organometallic compound, and having a third index of refraction higher than said second index of refraction; and a fourth layer adjacent said third layer, formed of a spin-coated alcohol solution of silicon alkoxide, and having a fourth index of refraction lower than said third index of refraction.

9. The cathode-ray tube of claim 8, wherein said first layer and said third layer are of identical composition.

10. The cathode-ray tube of claim 8, wherein said second layer and said fourth layer are of identical composition.

11. The cathode-ray tube of claim 1, wherein said anti-reflective coating also comprises conductive filler particles.

12. The cathode-ray tube of claim 11, wherein said conductive filler particles are disposed in said first layer.

13. The cathode-ray tube of claim 11, wherein said conductive filler particles are disposed in said first layer and said second layer.

14. The cathode-ray tube of claim 11, wherein said conductive filler particles comprise tin oxide.

15. The cathode-ray tube of claim 11, wherein said conductive filler particles comprise indium oxide.

16. The cathode-ray tube of claim 1, wherein said anti-reflective coating also comprises a colorant.

17. The cathode-ray tube of claim 16, wherein said colorant is disposed in said second layer.

18. The cathode-ray tube of claim 16, wherein said colorant is disposed in said first layer and said second layer.

19. The cathode-ray tube of claim 16, wherein said colorant is an organic dye.

20. The cathode-ray tube of claim 16, wherein said colorant is an inorganic dye.

21. The cathode-ray tube of claim 16, wherein said colorant is an organic pigment.

22. The cathode-ray tube of claim 16, wherein said colorant is an inorganic pigment.

23. The cathode-ray tube of claim 1, wherein said second layer also comprises magnesium fluoride particles having an average diameter not exceeding one thousand angstroms.

24. The cathode-ray tube of claim 23, wherein said magnesium fluoride particles have an average diameter not exceeding three hundred angstroms.

25. An image display panel, comprising a tinted faceplate, with an optical transmittance of at most fifty percent of light therefrom; and an anti-reflective coating formed on the tinted faceplate, the anti-reflective coating including, a first layer of a first index of refraction, adjacent the tinted faceplate, including an organometallic oxide, with conductive filler particles and contrast improving colorant particles therein, and a second layer of a second index of refraction lower than the first index of refraction, adjacent the first layer, including a silicon oxide layer with conductive filler particles and contrast improving colorant particles therein.

26. The image display panel of claim 25, wherein said first layer and said second layer have respective thicknesses equal to one-fourth of a wavelength of visible light.

27. The image display panel of claim 25, wherein said organometallic oxide comprises titanium as a metallic element.

28. The image display panel of claim 25, wherein said organometallic oxide comprises tantalum as a metallic element.

29. The image display panel of claim 25, wherein said organometallic oxide comprises zirconium as a metallic element.

30. The image display panel of claim 25, the anti-reflective coating further including, a third layer adjacent said second layer, formed of an organometallic oxide, and having a third index of refraction higher than said second index of refraction; and a fourth layer adjacent said third layer, formed of a silicon alkoxide, and having a fourth index of refraction lower than said third index of refraction.

31. The image panel of claim 30, wherein said first layer and said third layer are of identical composition.

32. The image panel of claim 30, wherein said second layer and said fourth layer are of identical composition.

33. An anti-reflective coating for use on a tinted faceplate, with an optical transmittance of at most fifth percent, of a cathode ray tube, comprising:

a first layer, adjacent the tinted faceplate, of a first index of refraction, including an organometallic oxide with conductive filler particles and contrast improving coloring particles therein; and a second layer, adjacent the first layer, of a second index of refraction lower than the first index of refraction, including a silicon oxide layer with conductive filler particles and contrast improving colorant particles therein.

34. The anti-reflective coating of claim 33, wherein said first layer and said second layer have respective thicknesses equal to one-fourth of a wavelength of visible light.

35. The anti-reflective coating of claim 33, wherein said organometallic oxide comprises titanium as a metallic element.

36. The anti-reflective coating of claim 33, wherein said organometallic oxide comprises tantalum as a metallic element.

37. The anti-reflective coating of claim 33, wherein said organometallic oxide comprises zirconium as a metallic element.

38. The anti-reflective coating of claim 33, further comprising:

a third layer adjacent said second layer, formed of an organometallic oxide, and having a third index of refraction higher than said second index of refraction; and a fourth layer adjacent said third layer, formed of a silicon alkoxide, and having a fourth index of refraction lower than said third index of refraction.

39. The anti-reflective coating of claim 38, wherein said first layer and said third layer are of identical composition.

40. The anti-reflective coating of claim 38, wherein said second layer and said fourth layer are of identical composition.

* * * * *